United States Patent [19]

Johnson

[11] Patent Number: 4,998,085

[45] Date of Patent: Mar. 5, 1991

[54] FRONT SURFACE GRID FOR THERMOSTAT SUBBASE

[75] Inventor: Vern C. Johnson, Moundsview, Minn.

[73] Assignee: Honeywell Inc., Minneapolis, Minn.

[21] Appl. No.: 454,231

[22] Filed: Dec. 21, 1989

[51] Int. Cl.[5] ..... H01H 37/52; H01H 37/04

[52] U.S. Cl. ..... 337/2; 200/DIG. 29; 337/373; 337/380

[58] Field of Search ..... 337/373, 374, 375, 376, 337/380, 381, 298, 2; 200/DIG. 29

[56] References Cited

PUBLICATIONS

Honeywell Form No. 60-2246-2, *Thermostat Subbases*, Honeywell Inc., Rev. 9-88.

*Primary Examiner*—H. Broome

*Attorney, Agent, or Firm*—Gregory A. Bruns

[57] ABSTRACT

A thermostat subbase has a conductive grid located on a first surface of an insulating base. Terminals for connection to the controlled heating and cooling apparatus and terminals for connection to a thermostat are integrally formed from the conductive grid. Manual switching is provided to connect adjoining grid portions. The adjoining grid portions extend over a pocket formed in the base and are shaped to receive a conductive ball.

7 Claims, 4 Drawing Sheets

FRONT SURFACE GRID FOR THERMOSTAT SUBBASE

BACKGROUND OF THE INVENTION

The invention disclosed herein relates to thermostat subbases and particularly to subbases using conductive paths cut from a grid of conductive material for interconnections within the subbase rather than individual conductors.

Thermostat subbases are typically mounted on a wall and include terminals for electrical connection of field control wiring from the heating and cooling apparatus. After the control wiring is connected to the terminals, a thermostat is typically mounted on the subbase and electrically interconnected to the subbase. The subbase typically also performs functions such as selecting either heating or cooling apparatus to be controlled by the thermostat. Other typical subbase functions include selecting an operating mode for an air circulating fan or providing light or LED indication of system status.

Numerous electrical terminal connections and the switching functions require that many individual conductive paths are provided in a thermostat subbase. The use of separate conductors and separate switches is a labor intensive approach to this need. Therefore this requirement has lead to various other approaches. One approach is the use of a conductive grid which can be placed on a subbase and then segmented into various conductive portions or paths.

Subbases are known which locate the conductive grid on the back surface of the subbase. Separate conductive terminals are then mechanically attached to the grid and extend through the subbase. These terminals are then used for both field control wiring and thermostat interconnections. Switching can be provided by extending the ends of grid portions through the base and using a switch lever to move a conductive ball across the ends of the grid portions.

Subbases having a back surface grid provide generally satisfactory performance but have certain disadvantages. The use of separate conductive terminals that are mechanically secured to the grid requires the use of screw machine manufactured terminals and individual handling of the terminals resulting in a costly subbase. The present invention eliminates troublesome electrical connections and handling of loose parts in an automated process.

Switching a conductive ball across the rounded ends of grid portions that extend through the subbase generally provides satisfactory operation. It does require accurate alignment of the rounded ends to assure sufficient contact of adjoining ends by the conductive ball.

SUMMARY OF THE INVENTION

The present invention solves these and other needs by providing a thermostat subbase for use with a thermostat for the controlling of heating and cooling apparatus. In the embodiment shown the subbase includes a base of insulating material and a grid of conductive material. The base has a front surface including upstanding projections. The grid has apertures that receive the upstanding projections when the grid is placed on the first surface with the projections then flattened or staked to secure the grid to the base. Tie bars extending between grid portions pass over holes that extend through the base. A cutting tool passing through the base from the back surface to the front surface cuts out portion of selected tie bars.

A switch includes a conductive ball biased toward the base and moved by a switch lever to connect adjoining grid portion. The adjoining grid portions have edges curled toward the base and the base has a pocket to provide clearance for the curled edges and the movement of the conductive ball.

DESCRIPTION

Figure 1:
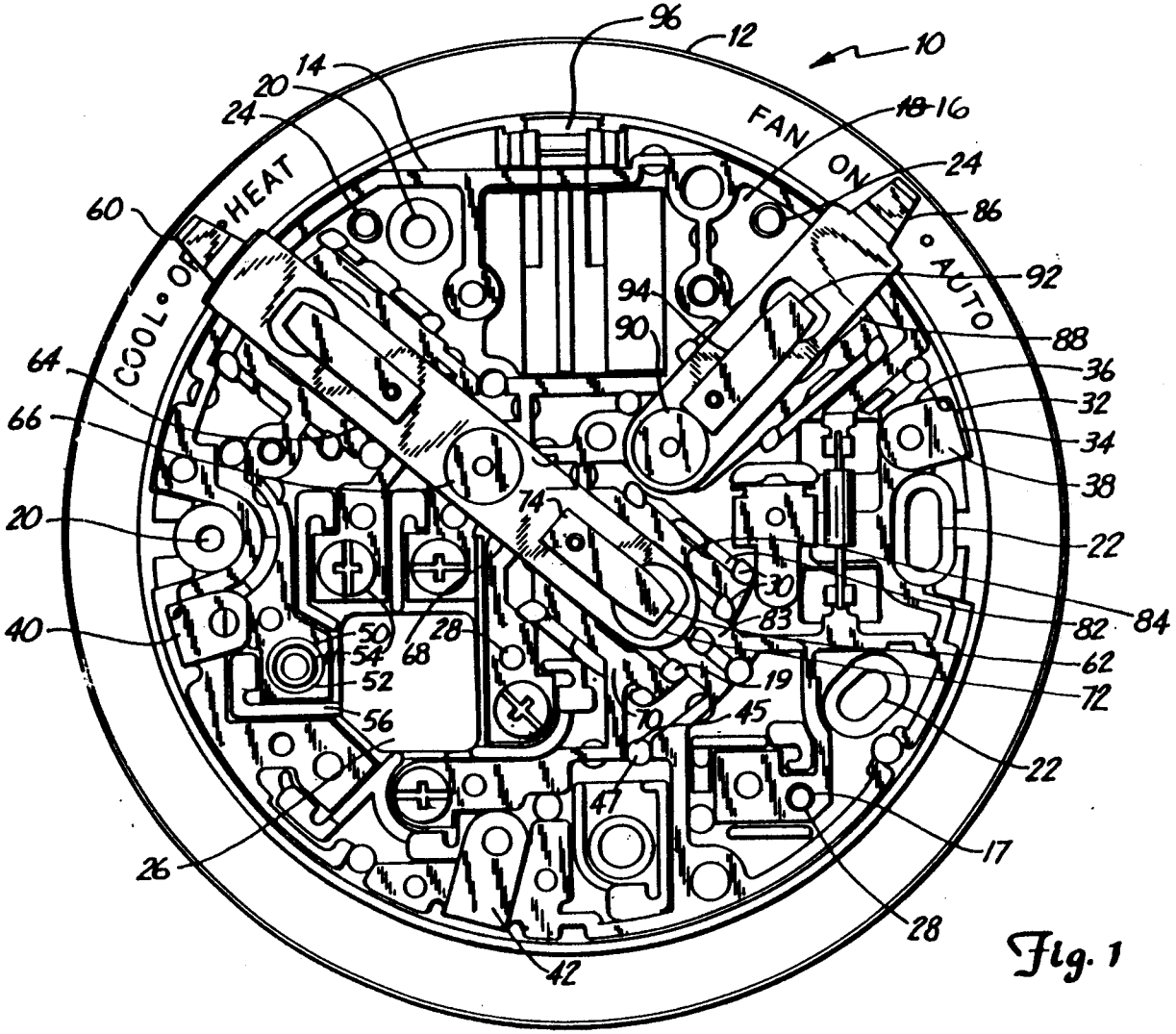
FIG. 1 is a plan view of a thermostat subbase in accordance with applicant's invention.
Figure 2:
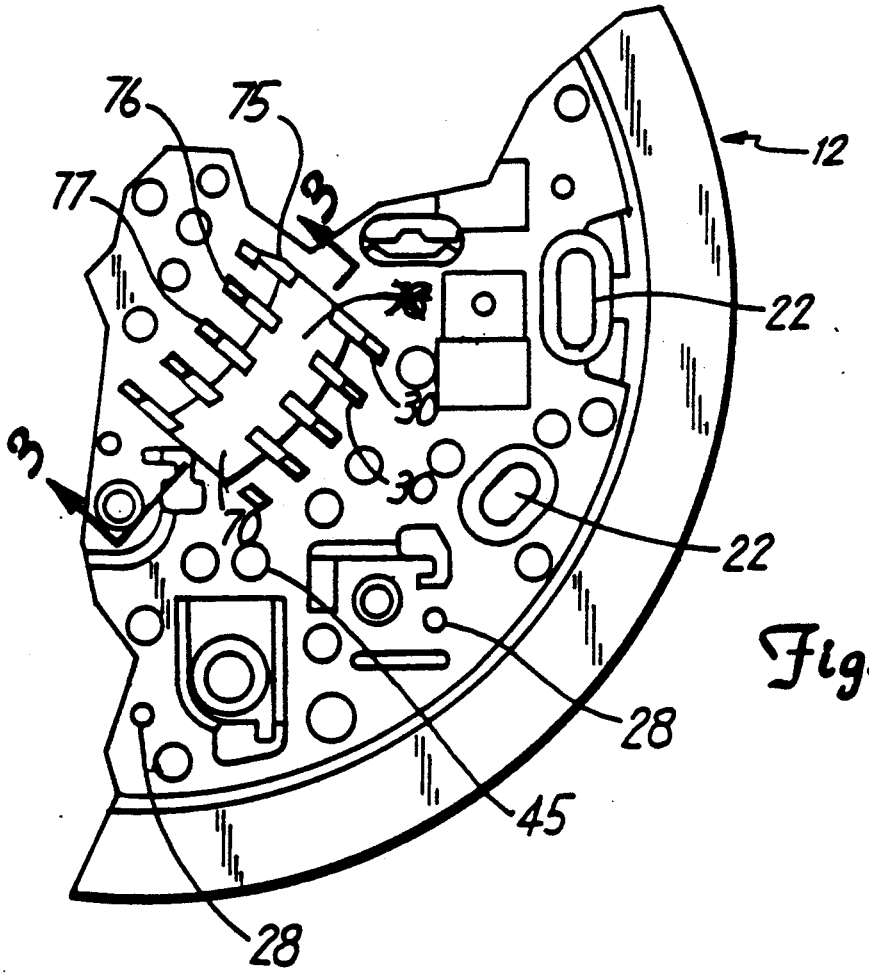
FIG. 2 is a plan view of a portion of the base only of the subbase of FIG. 1.

A thermostat subbase in accordance with applicant's invention is shown in the drawings and generally designated 10.

Subbase 10 includes a base 12 of an insulating material such as molded plastic and a conductive grid 14 of brass or another suitable conductive material.

Base 12 includes front surface 16 and back surface 18. Holes 20 and slots 22 are provided for mounting subbase 10 to a wall. Leveling posts 24 are intended for use with a spirit level during the mounting of subbase 10.

Opening 26 is provided to allow a thermostat cable to pass through base 12 for connection to terminals hereinafter described. Hole 45 is typical of holes in the base which allow passage of a cutting tool. Upstanding projections of type 28 have a generally circular cross section. Upstanding projections of type 30 have a generally rectangular cross section. Both projections of type 28 and type 30 pass through openings, or apertures in grid 14 when it is placed on the front surface of base 16. The projections are then compressed or cold staked to secure grid 14 to base 12.

Conductive grid 14 is formed by stamping from brass or other suitable material to provide a single contiguous conductive grid. Openings in grid 14 include holes such as 17 and spaces between grid portions such as 19. Grid 14 will later be divided into individual grid portions.

Thermostat interconnection terminals are integrally formed from grid 14. For example thermostat interconnection terminal 32 includes upright extension 34, threaded portion 38 and brace 36. The forming of the terminal from extended grid ear 39 is done before placing grid 14 on base 12. Thermostat interconnection terminal 40 is of similar construction to terminal 32. Thermostat interconnect terminal 42 does not include brace 36 but rests on support 44 which is part of base 12.

System terminals or field terminals are provided for electrical connection in the field of the heating and cooling apparatus to the subbase 10. Field terminals are located adjacent to opening 26 in base 12. Field terminal 50 is representative of the field terminals. Terminal portion 52 is integrally formed from grid 14. A screw 54 is used to secure a conductor from the heating and cooling apparatus to terminal portion 52. During connection shield 56 guides the conductor between terminal portion 52 and the screw head. Tightening screw 54 then secures the conductor to terminal portion 52.

In the manufacturing process, after grid 14 is placed on front surface 16 of base 12 and cold staked by compressing the upstanding projections, the grid is divided into individual conductive portions. The dividing is accomplished by passing a cutting tool through a hole such as hole 45 in base 12 in the direction from the back surface 18 toward front surface 16. For example hole 45 shows a tie bar 47 that has had a portion removed by the cutting tool operation described.

System switch 60 is typically used for placing the heating and cooling apparatus in the heating mode or, the cooling mode or turning the apparatus off.

Switching action is accomplished by selectively connecting adjoining portions of the grid with a conductive ball 62. The switch includes a switch lever 64 pivotally mounted by an eyelet 66 to base 12. End 68 of lever 64 extends over adjoining conductors at a location where they bridge pocket 70. When the lever is rotated about 66, then end 68 will move in an arc over pocket 70 and adjoining grid portions. System switch lever 64 includes a hole 72 for carrying conductive ball 62. Spring 74 is secured to end 68 of lever 64 and biases conductive ball 62 toward base 12.

Figure 3:
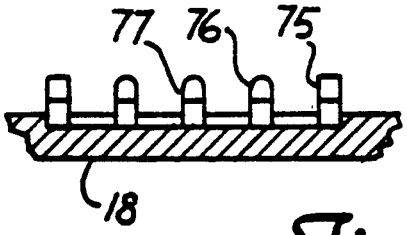
FIG. 3 is a cross section of the base only along section line 3—3 of FIG. 2.
Figure 4:
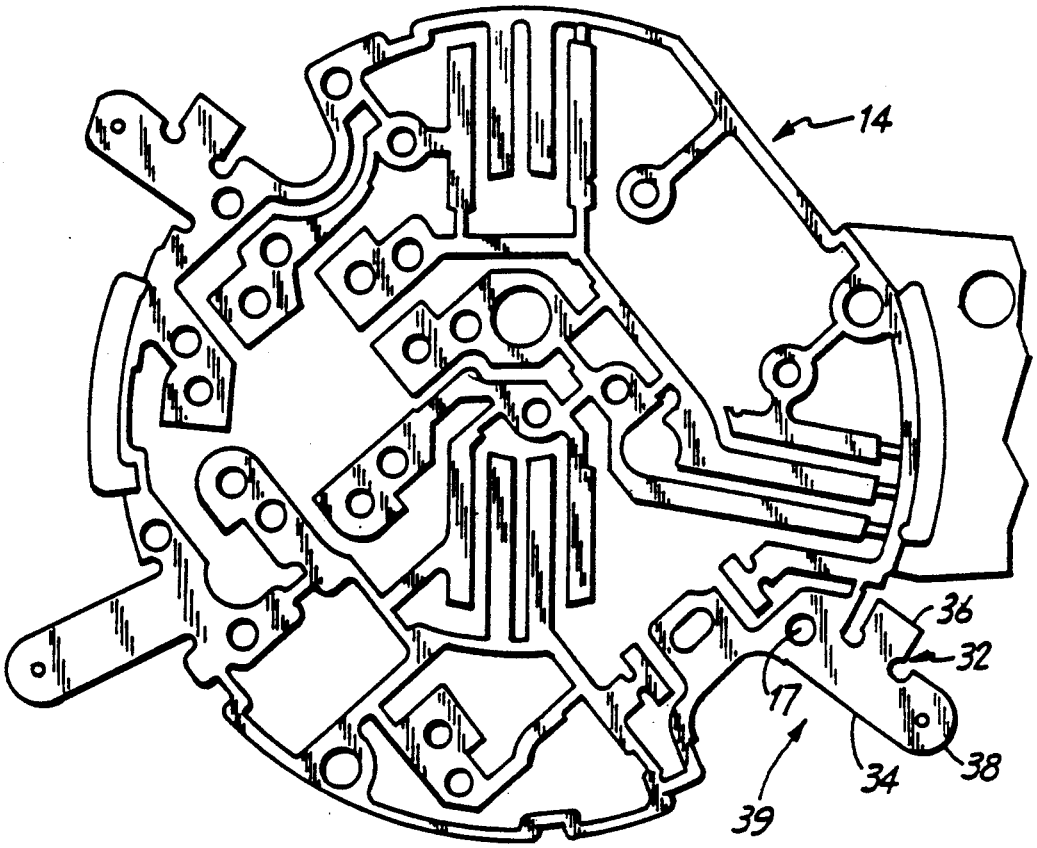
FIG. 4 is a plan view of the grid only of the subbase of FIG. 1 with the grid shown unformed.
Figure 5:
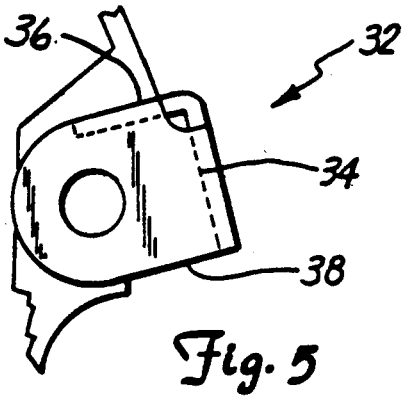
FIG. 5 is a plan view of the portion of FIG. 4 formed into a terminal.

For example, adjoining grid portions 82 and 83 are generally parallel and extend across molded pocket 70 of base 12. As shown in FIG. 3, grid alignment guides 75, 76 and 77 space adjoining grid portions apart. Molded pocket 70 provides a relief for the formed grid portion and the conductive ball during switching. Upstanding projections 30 are provided for cold staking the grid to the subbase by compressing the top of the upstanding projections.

Figure 6:
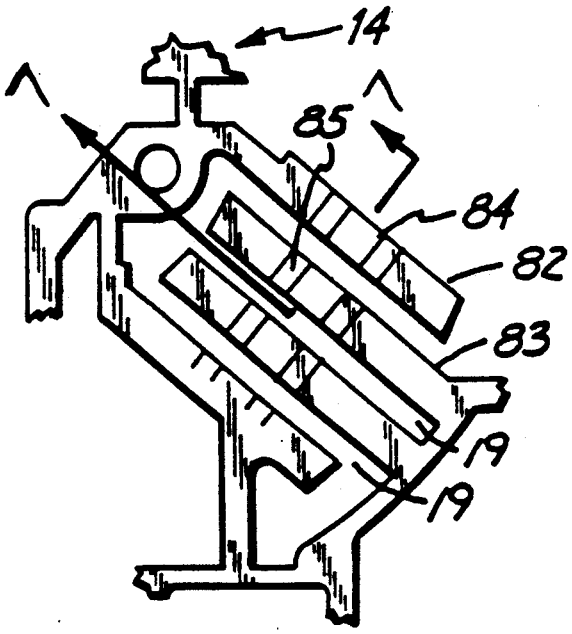
FIG. 6 is an enlarged plan view of a portion of the grid only of FIG. 1.
Figure 7:
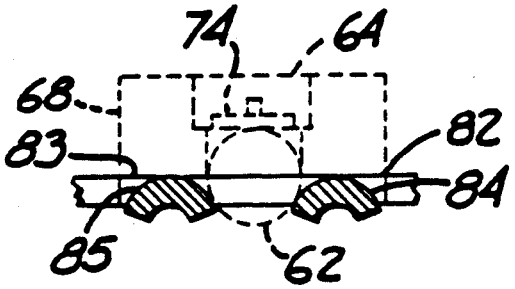
FIG. 7 is a cross-section of the grid of FIG. 6 along section line 7—7 of FIG. 6 with the switching lever, spring and conductive ball shown in phantom.

An enlarged detail of a portion of grid 14 is shown in FIG. 6 to illustrate the shape of the adjoining grid portions that are connected by the system switch 60. Grid portions 82 and 83 have sections 84 and 85 respectively which are shaped or curled before grid 14 is placed on base 12. The shape of sections 84 and 85 is also shown in FIG. 7 which is an elevation drawing also showing conductive ball 62 and switch lever 64 Adjoining grid sections 84 an 85 may use a silver top lay and conductive ball 62 may be silver plated to improve switch conductivity.

Thermostat subbases typically also include a fan switch for turning the fan on or placing the fan in the auto mode. Fan switch 86 includes switch lever 88 mounted to base 12 by eyelet 90. Lever 88 extends over adjoining conductors of grid 14 and includes ball 92 and spring 94.

A light emitting diode (LED) may be used in conjunction with subbase 10 as an indicator to the user to check a particular element of the heating or cooling system. When used, the LED is installed in LED holder 96.

Now that the construction and operation of subbase 10 have been set forth, certain advantages can be set forth and appreciated.

Past subbases which had the conductive grid located on the back surface required the use of individual screw machine manufactured terminals. These terminals were then individually joined with a crimp type connection to the grid with the terminal extending through the subbase. The terminals were then accessible at the front surface of the subbase for connection to the heating and cooling apparatus and for interconnection of the thermostat.

The present invention eliminates the need for the use of screw machine type terminals. In subbase 10 all terminals for connection to the heating and cooling apparatus and for the interconnection to the thermostat are integrally formed with the grid. For example field terminal 50 and thermostat interconnection terminal 38 are integrally formed from conductive grid 14.

The integral forming of terminals in the present invention assures high electrical conductivity and eliminates troublesome electrical connections.

Further the elimination of the need for handling individual screw machine type terminals allows greater use of automated assembly methods which result in a lower manufacturing costs for the subbase.

The placement of adjoining grid portions on the front surface of base 12 allows an improved subbase switching arrangement when compared with subbases having the grid on the back surface. For example by providing grid alignment guides 75, 76 and 77 the adjoining grid portions 82 and 83 are securely positioned in a parallel relationship. The compression of upstanding projections 30 by cold staking assures that adjoining grid portions 82 and 83 are securely fixed to base 12. The shaping of sections 84 and 85 and their bridging over molded pocket 70 allows an increased contact area between conductive ball 62 and sections 84 and 85. The increased contact area helps to assure reliable switching over long periods of time.

In accordance with the foregoing description applicant has developed an improved thermostat subbase.

Although a specific embodiment of the applicant's improved subbase is shown and described for illustrative purposes, a number of variations and modifications will be apparent to those of ordinary skill in the relevant arts. It is not intended that coverage be limited to the disclosed embodiment, but only by the terms of the following claims.

I claim:

1. A thermostat subbase for mounting a thermostat thereon with the thermostat and the subbase adapted to control heating and cooling apparatus, comprising:

a base of insulating material, the base having a front surface having upstanding projections, a back surface, and holes extending through the base for receiving a cutting tool;

a grid of conductive material comprising;

electrical terminals integrally formed from said grid for connection to the thermostat to improve conductivity;

openings in said grid located to receive the upstanding projections when the grid is placed on the front surface, with the projections then being staked to secure the grid to the front surface;

tie bars between grid portions for electrically connecting said portions, said tie bars extending over said holes so that a cutting tool when moving in a direction from the back surface toward the front surface will cut out portions of said tie bar;

switch means including a conductive ball for connecting a first portion of said grid to an adjoining second portion of said grid, said ball being biased toward the front surface and attached to a lever pivotally mounted to said base for positioning the ball to contact said first and second grid portions, said grid portions contacted by said ball having flat switching segments with edges curled toward the base to increase the contact area of the ball with said grid portions to improve conductivity.

2. The thermostat subbase of claim 1 wherein said integrally formed electrical terminals include a first group of electrical terminals upstanding from the grid for mechanically mounting and electrically connecting the thermostat to the subbase; and a second group of electrical terminals adapted for electrically connecting said grid of the subbase to the heating and cooling apparatus.

3. The thermostat subbase of claim 1 wherein the switching segments of the grid portions are selectively top layered with silver to improve conductivity.

4. The thermostat subbase of claim 3 wherein said ball is silver plated to improve conductivity.

5. In a thermostat subbase of the type for mounting a thermostat thereon, with the thermostat and the subbase adapted to connect to and control heating and cooling apparatus, the subbase including a plurality of conductors secured to a base, and switch means including a switch lever for positioning a conductive ball to connect a selected conductor to an adjoining conductor, the ball being biased toward the base and with the subbase further having a first group of electrical terminals for connecting a first group of conductors to the heating and cooling apparatus and a second group of electrical terminals for connecting a second group of conductors to the thermostat, the improvement which comprises:

the switch means further including the selected conductor and the adjoining conductor having switching portions, said switching portions having edges curled toward the base for increasing the contact area of the ball with the selected conductor and the adjoining conductor for improving electrical conductivity; and each electrical terminal being integrally formed with the conductor it serves to improve electrical conductivity.

6. The thermostat subbase of claim 4 wherein the curled portions of the selected conductor and the adjoining conductor have a silver top layer to improve conductivity.

7. The thermostat subbase of claim 6 wherein said ball is silver plated to improve conductivity.

* * * * *